US010309713B2

(12) United States Patent
Tiranno et al.

(10) Patent No.: US 10,309,713 B2
(45) Date of Patent: Jun. 4, 2019

(54) SCHEDULING DEFROST EVENTS AND LINKING REFRIGERATION CIRCUITS IN A REFRIGERATION SYSTEM

(71) Applicant: Honeywell International Inc., Morristown, NJ (US)

(72) Inventors: Charles J. Tiranno, Wadsworth, OH (US); Victor Lavrisiuk, Aurora, OH (US)

(73) Assignee: Honeywell International Inc., Morris Plains, NJ (US)

( * ) Notice: Subject to any disclaimer, the term of this patent is extended or adjusted under 35 U.S.C. 154(b) by 1184 days.

(21) Appl. No.: 14/520,564

(22) Filed: Oct. 22, 2014

(65) Prior Publication Data

US 2016/0116203 A1 Apr. 28, 2016

(51) Int. Cl.
*F25D 21/00* (2006.01)

(52) U.S. Cl.
CPC ..... *F25D 21/006* (2013.01); *F25D 21/002* (2013.01); *F25D 21/004* (2013.01); *F25D 21/008* (2013.01); *F25D 2400/361* (2013.01); *F25D 2700/02* (2013.01)

(58) Field of Classification Search
CPC ..... F25D 21/006; F25D 2700/02; F25D 2400/361; F25D 21/008; F25D 21/002; F25D 21/004
USPC ..... 62/151, 155
See application file for complete search history.

(56) References Cited

U.S. PATENT DOCUMENTS 7,716,936 B2 5/2010 Bailey et al.
2003/0141292 A1 7/2003 Chasen et al.
2004/0107727 A1* 6/2004 Kim ..... F25B 5/04 62/525

FOREIGN PATENT DOCUMENTS

EP 1482256 12/2004
EP 1496324 1/2005

OTHER PUBLICATIONS

Parker, "Defrost Controller, Product Bulletin 90-00", Parker Hannifin Corporation. May 28, 2009.*
Parker, "Defrost Controller, Product Bulletin 90-00", Parker Hannifin Corporation. May 28, 2009 (Year: 2009).*
(Continued)

*Primary Examiner* — Frantz F Jules
*Assistant Examiner* — Steve S Tanenbaum
(74) *Attorney, Agent, or Firm* — Seager, Tufte & Wickhem LLP

(57) ABSTRACT

Methods, devices, and systems for scheduling defrost events and linking refrigeration circuits in a refrigeration system are described herein. One method includes receiving, by a computing device, a number of defrost events per day for a refrigeration circuit, a duration for each of the number of defrost events, a start time for an initial one of the number of defrost events, and a maximum number of concurrent defrost events for the refrigeration system, determining, by the computing device, a defrost event schedule for the refrigeration circuit based on the number of defrost events per day, the duration for each of the number of defrost events, the start time for the initial one of the number of defrost events, and the maximum number of concurrent defrost events, receiving, by the computing device, an adjustment to the determined defrost event schedule, and updating, by the computing device, the defrost event schedule based on the adjustment.

7 Claims, 8 Drawing Sheets

220

Max Concurrent Defrosts: 2
Cms Display Delay After Defrost: 15 MIN
Defrost Schedules

Circuit Status

| | Circuit01 | Circuit02 | Circuit03 | Circuit04 | Circuit05 | Circuit06 | Circuit07 |
|---|---|---|---|---|---|---|---|
| Circuit Name | Fake | ORL | Ckt3 | Ckt4 | DxRcc | Ckt6 | Ckt7 |
| Type | Standard | Standard | Standard | Standard | DX System EEPR | Standard | Standard |
| Control Temp | 36.79° F | 33.16° F | 33.35° F | 33.29° F | 32.85° F | 34.00° F | 40.00° F |
| Active Setpoint | 36.90° F | 34.00° F | 34.00° F | 34.00° F | 34.00° F | 34.00° F | 34.00° F |
| Op Mode | On | On | Off | Off | Cooling | On | On |
| Mode Time | 0.5 min | 0.7 min | 0.3 min | 0.5 mon | 3.3 min | 47.7 min | 117.2 min |
| Sync Defrost To | None | None | None | None | None | None | None |
| Def Term Temp | 36.79° F | false | 83.00° F | false | 32.85° F | 34.00° F | 40.00° F |
| Def Override | No Action | No Action | No Action | No Action | No Action | No Action | No Action |
| Def Pending | No | No | No | No | No | No | No |
| Def Schedule Type | Defr Per Day | Defr Per Day | Defr Per Day | Defr Per Day | Defr Per Day | Defr Per Day | Defr Per Day |
| Eepr Valve Pos | -- | -- | -- | -- | 1.3 % | 30.0 % | -- |
| | | | | | | | |
| Case Temp Sensor(S) | 36.8° F | 33.2° F | 33.4° F | 33.3° F | 32.9° F | 34.0° F | 40.0° F |
| | | | 74.3° F | | | | |
| Dt Switch Input(S) | | false | | | | | |
| | | | | | | | |
| | | **Ckt3_Case01** | | | | | |
| Discharge Air Temp | | 74.3° F | | | | | |
| Super Heat Reading | | 7.4° F | | | | | |
| Valve Position | | 66.4 % | | | | | |

(56) References Cited

OTHER PUBLICATIONS

"Appliance411 FAQ: How does a Frost Free Refigerator's Defrost System Work?". http://www.appliance411.com/faq/howdefrostworks.shtml. Date Accessed: Apr. 24, 2014. 6 pgs.
"Defrost Controller, Product Bulletin 90-00", Parker Hannifin Corporation. May 28, 2009. 20 pgs.
"User Manual", Carel Technology & Evolution. Jun. 25, 2001. 60 pgs.
"Wizard Industrial Refrigeration Control", Genesis-international Inc. May 2, 2010.

* cited by examiner

220

Max Concurrent Defrosts: 2

Cms Display Delay After Defrost: 15 MIN

Defrost Schedules

Circuit Status

| | Circuit01 | Circuit02 | Circuit03 | Circuit04 | Circuit05 | Circuit06 | Circuit07 |
|---|---|---|---|---|---|---|---|
| Circuit Name | Fake | ORL | Ckt3 | Ckt4 | DxRcc | Ckt6 | Ckt7 |
| Type | Standard | Standard | Standard | Standard | DX System EEPR | Standard | Standard |
| Control Temp | 36.79° F | 33.16° F | 33.35° F | 33.29° F | 32.85° F | 34.00° F | 40.00° F |
| Active Setpoint | 36.60° F | 34.00° F | 34.00° F | 34.00° F | 34.00° F | 34.00° F | 34.00° F |
| Op Mode | On | On | Off | Off | Cooling | On | On |
| Mode Time | 0.5 min | 0.7 min | 0.3 min | 0.5 mon | 3.3 min | 47.7 min | 117.2 min |
| Sync Defrost To | None | None | None | None | None | None | None |
| Def Term Temp | 36.79° F | false | 83.00° F | false | 32.85° F | 34.00° F | 40.00° F |
| Def Override | No Action | No Action | No Action | No Action | No Action | No Action | No Action |
| Def Pending | No | No | No | No | No | No | No |
| Def Schedule Type | Defr Per Day | Defr Per Day | Defr Per Day | Defr Per Day | Defr Per Day | Defr Per Day | Defr Per Day |
| Eepr Valve Pos | -- | -- | -- | -- | 1.3 % | 30.0 % | -- |
| | | | | | | | |
| Case Temp Sensor(S) | 36.8° F | 33.2° F | 33.4° F | 33.3° F | 32.9° F | 34.0° F | 40.0° F |
| | | | 74.3° F | | | | |
| Dt Switch Input(S) | | false | | | | | |
| | | | | | | | |
| | | **Ckt3_Case01** | | | | | |
| Discharge Air Temp | | 74.3° F | | | | | |
| Super Heat Reading | | 7.4° F | | | | | |
| Valve Position | | 68.4 % | | | | | |

*Fig. 2*

660

- Ckt6

Configuration | Case Controllers | Defrost Notification | I/O Overview | Data Logs

Circuit Status

| | | | | | |
|---|---|---|---|---|---|
| | | | | **Defrost Output:** | false |
| **Control Temp:** | 34.00° F | **Defrost Term Temp:** | 34.00° F | **Evap fan output:** | true |
| **Active Setpoint:** | 34.00° F | **Defrost Pending:** | No | **LLSV Output:** | true |
| **Op Mode:** | On | **Next Scheduled Defrost Time:** | 13-Nov-13 12:00PM EST | **EEPR Output:** | 3.0 V |
| **Mode Time:** | 51.2 min | | | **EEPR Value Pos:** | 30.0 % |
| **Last Defrost Duration:** | 4.6 min | **Maintenance Switch Input:** | -- | | |
| **Time Since Last Defrost:** | 0.92 hr | **Door Switch In:** | -- | | |
| **CaseTemp_06:** | 34.0° F | | | | |

Temperature Control Settings

| | | | | | |
|---|---|---|---|---|---|
| **Dual Temp Switch:** | Disabled | | | **Door Switch Monitor:** | No |
| **Setpoint:** | 34.00 ° F | | | | |
| **Deadband:** | 2.00 Δ° F | | | | |
| **Alarm High Offset:** | 12.00 ° F | **Alarm Low Offset:** | -12.00 ° F | **Maintenance Shutdown:** | No |
| **Case Control Method:** | Maximum | | | | |
| **Valve Mode:** | EEPR | | | EEPR PID | I/O Setup |

Defrost Control Settings

| | | | | | |
|---|---|---|---|---|---|
| **Defrost Type:** | Electric | **Sync Defrost To:** | None | **Defrost Override:** | No Action |
| **Max Def Time:** | 15 min | | | **Drain Delay Time:** | 1 min |
| **Min Defrost Time:** | 1 min | | | **Pump Out Delay:** | 1 min |
| **Termination Setpoint:** | 55.00 ° F | | | **Evap Fan Delay Time:** | 3 min |
| **Def Term Type:** | Case Temp Sensors / Minimum | | | **Observe Concurrency:** | Yes |
| **Defrost Sched Type:** | Defrosts Per Day | **Start Time:** | 12:00 AM | | |
| **Defrosts/Day:** | 16 | | | | |
| **Evap Fan During Def:** | Fan Off | | | | |
| **EEPR During Defrost:** | Closed | | | Defrost Schedule | I/O Setup |

*Fig. 6*

880

| Circuit Status | | | | | | | |
|---|---|---|---|---|---|---|---|
| | Circuit01 | Circuit02 | Circuit03 | Circuit04 | Circuit05 | Circuit06 | Circuit07 |
| Circuit Name | Fake | ORL | Ckt3 | Ckt4 | DxRcc | Ckt6 | Ckt7 |
| Type | Standard | Standard | Standard | Standard | DX System EEPR | Standard | Standard |
| Control Temp | 35.87° F | 33.65° F | 33.85° F | 33.76° F | 35.11° F | 27.54° F | 40.00° F |
| Active Setpoint | 36.60° F | 34.00° F | 34.00° F | 34.00° F | 34.00° F | 34.00° F | 34.00° F |
| Op Mode | On | On | Off | On | Cooling | On | On |
| Mode Time | 0.9 min | 0.6 min | 0.7 min | 0.4 mon | 3.2 min | 9.8 min* | 9.8 min |
| Sync Defrost To | None | None | None | None | None | None | Ckt6 |
| Def Term Temp | 35.87° F | false | 83.00° F | false | 35.11° F | 27.54° F | 40.00° F |
| Def Override | No Action | No Action | No Action | No Action | No Action | No Action | |
| Def Pending | No | No | No | No | No | No | No |
| Def Sched Type | Defr Per Day | Defr Per Day | Defr Per Day | Defr Per Day | Defr Per Day | Defr Per Day | |
| Eepr Valve Pos | -- | -- | -- | -- | 11.9 % | 67.8 % | -- |
| | | | | | | | |
| Case Temp Sensor(S) | 35.9° F | 33.7° F | 33.8° F | 33.8° F | 35.1° F | 27.5° F | 40.0° F |
| | | | 74.3° F | | | | |
| Dt Switch Input(S) | | false | | | | | |
| | | | | | | | |
| | | **Ckt3_Case01** | | | | | |
| Discharge Air Temp | | 74.3° F | | | | | |
| Super Heat Reading | | 7.4° F | | | | | |
| Valve Position | | 59.2 % | | | | | |

*Fig. 8*

SCHEDULING DEFROST EVENTS AND LINKING REFRIGERATION CIRCUITS IN A REFRIGERATION SYSTEM

TECHNICAL FIELD

The present disclosure relates to methods, devices, and systems for scheduling defrost events and linking refrigeration circuits in a refrigeration system.

BACKGROUND

A refrigeration system in a grocery store may include a large number of refrigeration circuits (e.g., display cases and/or walk-in coolers). The refrigeration system may also include a control system to centrally manage the temperature and/or defrost events (e.g., cycles) of the refrigeration circuits.

In previous refrigeration systems, the defrost event schedule for a refrigeration circuit is typically set manually by a user. That is, the user manually (e.g., individually) sets (e.g., enters and configures) each of the defrost events for the circuit in the schedule. Further, in manually setting the defrost event schedule for the circuit, the user may have to account for the defrost event schedules of the other refrigeration circuits of the system. For example, the user may have to set the schedule such that only a certain (e.g., maximum) number of the circuits are concurrently defrosting at any given time. Accordingly, manually setting the defrost event schedule for a refrigeration circuit can be a difficult, time consuming task for the user.

Further, in some refrigeration systems, a group of refrigeration circuits may need to defrost at the same time. Previous refrigeration systems may account for this by manually configuring (e.g., designing and applying) logic elements (e.g., components and linkages) external to the circuits of the group that link the circuits together and synchronize their defrost events. These logic elements may also have to be manually tied to the central controller of the refrigeration system. This manual configuration of these logic elements, however, can be difficult and time consuming.

BRIEF DESCRIPTION OF THE DRAWINGS

FIGS. 2-8 illustrate examples of displays for scheduling defrost events and linking refrigeration circuits in a refrigeration system in accordance with one or more embodiments of the present disclosure.

DETAILED DESCRIPTION

Figure 1:
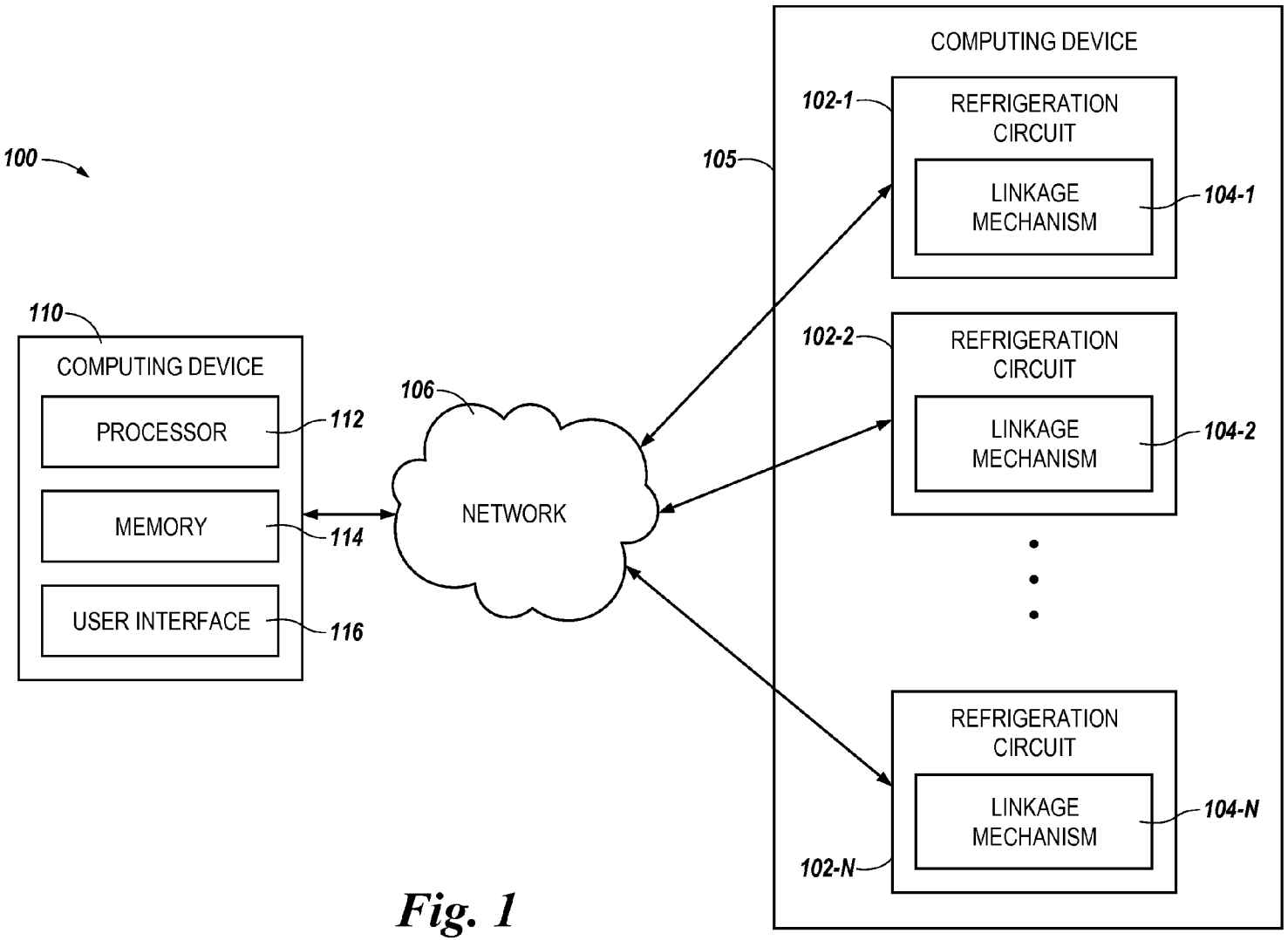
FIG. 1 illustrates a refrigeration system in accordance with one or more embodiments of the present disclosure.

Methods, devices, and systems for scheduling defrost events and linking refrigeration circuits in a refrigeration system are described herein. For example, one or more embodiments include receiving, by a computing device, a number of defrost events per day for a refrigeration circuit, a duration for each of the number of defrost events, a start time for an initial one of the number of defrost events, and a maximum number of concurrent defrost events for the refrigeration system, determining, by the computing device, a defrost event schedule for the refrigeration circuit based on the number of defrost events per day, the duration for each of the number of defrost events, the start time for the initial one of the number of defrost events, and the maximum number of concurrent defrost events, receiving, by the computing device, an adjustment to the determined defrost event schedule, and updating, by the computing device, the defrost event schedule based on the adjustment.

Scheduling defrost events in a refrigeration system in accordance with the present disclosure can be quicker and/or easier (e.g., more efficient) than scheduling defrost events in accordance with previous approaches. For example, a user can avoid having to manually set the defrost event schedules for the refrigeration circuits of a refrigeration system by scheduling the defrost events in accordance with the present disclosure. That is, the user can avoid having to manually (e.g., individually) set (e.g., enter and configure) each of the defrost events in the schedules. As such, embodiments of the present disclosure can make it simpler to create and edit defrost event schedules.

Further, refrigeration systems in accordance with the present disclosure can account for the fact that refrigeration circuits of the system may need to defrost at the same time utilizing a quicker and/or easier manner than with previous refrigeration systems. For example, refrigeration systems in accordance with the present disclosure may be able to account for this without manually configuring (e.g., designing and applying) logic elements (e.g., components and linkages) external to the refrigeration circuits and/or manually tying logic elements to the central controller of the refrigeration system.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of refrigeration circuits" can refer to one or more refrigeration circuits. Additionally, the designator "N" as used herein, particularly with respect to reference numerals in the drawings, indicates that a number of the particular feature so designated can be included with embodiments of the present disclosure.

FIG. 1 illustrates a refrigeration system 100 in accordance with one or more embodiments of the present disclosure. Refrigeration system 100 can be a refrigeration system of, for example, a grocery store.

As shown in FIG. 1, refrigeration system 100 can include a number of refrigeration circuits 102-1, 102-2, . . . , 102-N. Refrigeration circuits 102-1, 102-2, . . . , 102-N can be, for example, display cases and/or walk-in coolers of the grocery store. For instance, a refrigeration circuit may include a single display case or walk-in cooler, or multiple display cases or walk-in coolers. In some embodiments, due to the physical layout and/or mechanical design of refrigeration system 100, some of the refrigeration circuits may need to be defrosted in groups (e.g., at the same time).

As shown in FIG. 1, refrigeration circuits 102-1, 102-2, . . . , 102-N can be part of a computing device 105. Computing device 105 can be, for example, an embedded, on-site master system control panel.

As shown in FIG. 1, refrigeration system 100 can include a computing device 110. Computing device 110 can be, for example, a laptop computer, desktop computer, or mobile device (e.g., smart phone, tablet, PDA, etc.), among other types of computing devices. In some embodiments, computing device 110 can be a central controller for refrigeration system 100. For example, computing device 110 can be an off-site, enterprise management computer.

As shown in FIG. 1, computing device 110 can include a memory 114 and a processor 112. Memory 114 can be any type of storage medium that can be accessed by processor 112 to perform various examples of the present disclosure. For example, memory 114 can be a non-transitory computer readable medium having computer readable instructions (e.g., computer program instructions) stored thereon that are executable by processor 112 to perform various examples of the present disclosure. That is, processor 112 can execute the executable instructions stored in memory 114 to perform various examples of the present disclosure.

Memory 114 can be volatile or nonvolatile memory. Memory 114 can also be removable (e.g., portable) memory, or non-removable (e.g., internal) memory. For example, memory 114 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disk read-only memory (CD-ROM)), flash memory, a laser disk, a digital versatile disk (DVD) or other optical disk storage, and/or a magnetic medium such as magnetic cassettes, tapes, or disks, among other types of memory.

Further, although memory 114 is illustrated as being located in computing device 110, embodiments of the present disclosure are not so limited. For example, memory 114 can also be located internal to another computing resource (e.g., enabling computer readable instructions to be downloaded over the Internet or another wired or wireless connection).

As shown in FIG. 1, computing device 110 includes a user interface 116. A user of computing device 110, such as, for instance, an operator or configuration engineer of refrigeration system 100, can interact with computing device 110 via user interface 116. For example, user interface 116 can provide (e.g., display and/or present) information to the user of computing device 110, and/or receive information from (e.g., input by) the user of computing device 110. For instance, in some embodiments, user interface 116 can be a graphical user interface (GUI) that can include a display (e.g., a screen) that can provide and/or receive information to and/or from the user of computing device 110. The display can be, for instance, a touch-screen (e.g., the GUI can include touch-screen capabilities). As an additional example, user interface 116 can include a keyboard and/or mouse the user can use to input information into computing device 110. Embodiments of the present disclosure, however, are not limited to a particular type(s) of user interface.

Computing device 110 and refrigeration circuits 102-1, 102-2, . . . , 102-N can be coupled (e.g., communicate) via a network 106, as illustrated in FIG. 1. Network 106 can be a wired or wireless network of refrigeration system 100, such as, for instance, a wide area network (WAN) such as the Internet, a local area network (LAN), a personal area network (PAN), a campus area network (CAN), or metropolitan area network (MAN), among other types of networks. In the example illustrated in FIG. 1, network 106 (e.g., the connection between computing device 110 and refrigeration circuits 102-1, 102-2, . . . , 102-N) may be temporary.

As used herein, a "network" (e.g., network 106) can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, network 106 can tie a number of computing devices together to form a distributed control network.

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

Computing device 110 can schedule defrost events (e.g., defrost cycles) for refrigeration system 100 (e.g., refrigeration circuits 102-1, 102-2, . . . , 102-N). For example, computing device 110 can receive (e.g., from the user of computing device 110 via user interface 116), a selection of which refrigeration circuit(s) 102-1, 102-2, . . . , 102-N a defrost event schedule is to be determined for. Computing device 110 can then configure (e.g., based on input received from the user), for each respective selected refrigeration circuit, a desired number of defrost events per day for the circuit, the duration for each of the number of defrost events, the start time for the initial one of the number of defrost events, and the maximum number of concurrent defrost events for the selected circuits (e.g., the maximum number of the selected circuits that can be executing a defrost event at the same time). Computing device 110 can then determine the defrost event schedule for the respective circuit based on the desired number of defrost events per day, the duration for each of the number of defrost events, the start time for the initial defrost event, and the maximum number of concurrent defrost events. In some embodiments, the defrost event schedule for the respective circuit can also be determined based on (e.g., by summing) the maximum defrost time for that circuit, the pump out delay time (e.g., time between stopping refrigeration and starting defrost) for that circuit, and/or the drain delay time (e.g., the time between stopping defrost and starting refrigeration) for that circuit.

Computing device 110 can then display (e.g., to the user of computing device 110 via user interface 116) the determined defrost event schedule(s) for the selected circuit(s). Further, computing device 105 can execute the determined defrost event schedule(s) for the selected circuit(s). That is, computing device 105 can execute defrost events for the selected circuit(s) in accordance with the determined schedule(s).

In some embodiments, the determined defrost event schedule for the selected circuit(s) can include the same time interval between each of the defrost events. That is, the schedule may space the defrost events equally throughout the day.

The number of defrost events per day for each respective selected refrigeration circuit may be limited by computing device 110 to the maximum number of defrost events that can occur for that circuit during a day (e.g., based on the duration of the events and the start time for the initial event). Further, the maximum number of concurrent defrost events for the selected circuits may be based on the electrical load limit of the selected circuits and/or the equipment operating limit of the selected circuits.

The determined defrost event schedule for the selected circuit(s) can be for a 24 hour period (e.g., day). The determined schedule may be repeated (e.g., executed by computing device 105) for each day of the week.

In some embodiments, computing device 110 may receive (e.g., from the user of computing device 110 via user interface 116) an adjustment (e.g., change) to the determined defrost event schedule(s), and update the schedule(s) based on the adjustment. The adjustment may be received (e.g., made by the user) by a selection of a defrost event in the schedule, and an adjustment of the start time of the selected event through a text-based start time field or a dragging of the selected event to a different place in the displayed schedule. Computing device 105 can then execute the updated defrost event schedule(s), in a manner analogous to the determined defrost event schedule(s).

As an example, the adjustment to the determined defrost event schedule(s) may include an adjustment to the start time for the initial defrost event. As an additional example, the adjustment to the determined defrost event schedule(s) may include a change of the schedule(s) to a fixed defrost event schedule (e.g., a defrost event schedule manually entered by the user). That is, the adjustment may include overriding the determined schedule with the fixed schedule. However, embodiments of the present disclosure are not limited to a particular type(s) of adjustment to the determined defrost event schedule(s).

In some instances, the adjustment to the determined defrost event schedule(s) may shift one or more of the scheduled defrost events beyond the end of the schedule (e.g., beyond the end of the day). In such an instance, computing device 110 may display a message indicating that these defrost events will not be included in the updated defrost event schedule(s).

As shown in FIG. 1, each respective refrigeration circuit 102-1, 102-2, . . . , 102-N can include a linkage mechanism 104-1, 104-2, . . . , 104-N (e.g., refrigeration circuit 102-1 includes linkage mechanism 104-1, refrigeration circuit 102-2 includes linkage mechanism 104-2, etc.). Linkage mechanisms 104-1, 104-2, . . . , 104-N can be used to link refrigeration circuits 102-1, 102-2, . . . , 102-N, and account for the fact one or more groups of refrigeration circuits 102-1, 102-2, . . . , 102-N may need to be defrosted at the same time.

For example, the user of computing device 110 can designate (e.g., via user interface 116) which one of refrigeration circuits 102-1, 102-2, . . . , 102-N is a master circuit, and which refrigeration circuit(s) are slave circuits. The refrigeration circuit (e.g., the linkage mechanism of the circuit) designated as a master circuit can lead a defrost event for the circuit(s) designated as slave circuit(s), and the slave circuit(s) (e.g., the linkage mechanism of the slave circuit(s)) can follow the defrost event led by the master circuit, as will be further described herein. Between defrost events, the master circuit and slave circuit(s) may function individually.

The user of computing device 110 can designate the master and slave circuits by, for example, circuit name. For instance, each circuit (e.g., the linkage mechanism of each respective circuit) can include a property which holds the master circuit's name as a text string. The name property can serve as a reference that when null (e.g., empty) indicates that the circuit is the master. If the name property, however, has a name entered therein, that circuit is designated as a slave to the named circuit (e.g., the master circuit). That is, the linkage mechanism of each respective slave circuit includes the name of the master circuit in its respective name property.

Linkage mechanisms 104-1, 104-2, . . . , 104-N can determine the master/slave status of its respective refrigeration circuit 102-1, 102-2, . . . , 102-N. That is, linkage mechanisms 104-1, 104-2, . . . , 104-N can determine whether its respective refrigeration circuit 102-1, 102-2, . . . , 102-N is the master circuit or a slave circuit. Upon determining its respective refrigeration circuit is the master circuit, the linkage mechanism can lead a defrost event for the refrigeration circuits, and upon determining its respective refrigeration circuit is a slave circuit, the linkage mechanism can follow the defrost event led by the master circuit.

For example, upon determining its respective refrigeration circuit is the master circuit, the linkage mechanism can find (e.g., locate) its slave circuits. The linkage mechanism can find its slave circuits by reading the name property of each circuit for a match to its own name. Upon finding its slave circuits, the master circuit (e.g., its linkage mechanism) can determine whether each slave circuit is active or in shutdown (e.g., maintenance shutdown). The master circuit may ignore any slave circuits in shutdown, and read the composite termination readings of the active slave circuits.

Once the master circuit (e.g., its linkage mechanism) has located its slave circuit(s), it can initiate (and then subsequently terminate) the defrost event. Meanwhile, upon determining its respective refrigeration circuit is a slave circuit, the linkage mechanism can tie the defrost controls of its respective refrigeration circuit to the defrost controls of the master circuit. That is, when the master circuit initiates the defrost event, the slave circuit(s) follows its master's defrost event from pump-out to defrost heating to drain cycle, with the timing of the defrost event controlled by the master. The slave circuits(s) will resume cooling as the master circuit resumes its cooling cycle, and then operate normally until the master circuit initiates the next defrost event.

Further, the defrost controls of a slave circuit may not be editable. That is, the defrost controls of a respective refrigeration circuit may be non-editable upon the linkage mechanism of that circuit determining the circuit is a slave circuit. As such, the slave circuit may not initiate or terminate a defrost event, or use its own defrost schedule. Rather, there is a single location (e.g., the master circuit) where the defrost event parameters and settings for the slave circuit(s) may be managed. However, the slave circuit may provide defrost termination sensor inputs for the master circuit to read.

The master circuit can initiate and terminate (e.g., execute) the defrost event in accordance with a defrost event schedule for the master circuit. For example, the master circuit can initiate and terminate the defrost event in accordance with a defrost event schedule for the master circuit determined and/or adjusted by computing device 110, as previously described herein.

FIGS. 2-8 illustrate examples of displays for scheduling defrost events and linking refrigeration circuits in a refrigeration system in accordance with one or more embodiments of the present disclosure. The displays illustrated in FIGS. 2-8 can be displayed, for example, by user interface 116 of computing device 110 previously described in connection with FIG. 1.

Display 220 illustrated in FIG. 2 includes an overview of the configuration for the controls of a group of refrigeration circuits (e.g., Circuit01, Circuit02, Circuit03, Circuit04, Circuit05, Circuit06, and Circuit07) of a refrigeration system that execute defrost events (e.g., cycles). The refrigeration circuits can be, for example, circuits 102-1, 102-2, . . . , 102-N of refrigeration system 100 previously described in connection with FIG. 1.

As shown in FIG. 2, display 220 includes a "Max Concurrent Defrosts" field. The value entered in this field (e.g., by the user of the computing device) can set the maximum number of concurrent defrost events for the group of refrigeration circuits (e.g., the maximum number of circuits in the group that can be executing a defrost event at the same time). In the example illustrated in FIG. 2, the value entered in this field is 2. That is, in the example illustrated in FIG. 2, a maximum of two of Circuit01, Circuit02, Circuit03, Circuit04, Circuit05, Circuit06, and Circuit07 may execute a defrost event at the same time.

The user can select one of the refrigeration circuits of the group in display 220 to schedule defrost events for in accordance with the present disclosure. In the example illustrated in FIG. 3 (e.g., display 330), Circuit02 (e.g., the circuit with the name of ORL) has been selected.

Figure 3:
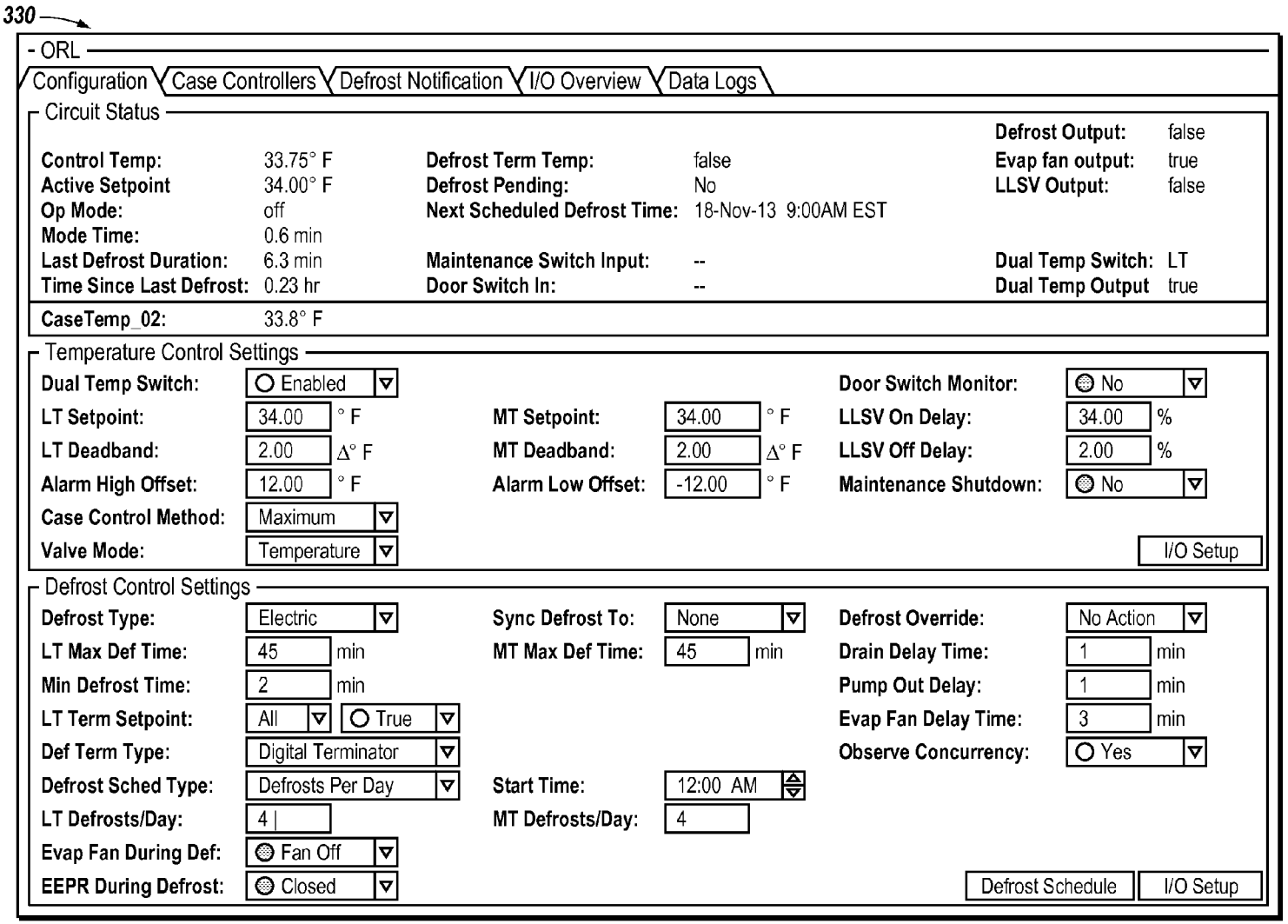

As shown in FIG. 3, display 330 includes the defrost control settings for the selected circuit (e.g., Circuit02). As shown in FIG. 3, the defrost control settings include an "LT Max Def Time" field, an "LT Defrosts/Day" field, a "Start Time" field, a "Drain Delay Time" field, and a "Pump Out Delay" field. The value entered in the LT Defrosts/Day" field can set the number of defrost events per day for the selected circuit, the value entered in the "LT Max Def Time" field can set the duration for each of the number of defrost events, the value entered in the "Start Time" field can set the start time for the initial one of the number of defrost events, the value entered in the "Drain Delay Time" field can set the drain delay time for the selected circuit, and the value entered in the "Pump Out Delay" field can set the pump out delay time for that circuit.

As shown in FIG. 3, the defrost control settings also include an "Observe Concurrency" field. The user can use this field to select whether or not the maximum number of concurrent defrost events set in display 220 of FIG. 2 is to be observed.

In the example illustrated in FIG. 3, default values are entered in the fields of the defrost control settings in display 330. That is, display 330 may default to 4 defrost events per day having a duration of 45 minutes each, a start time of 12:00 AM for the initial one of the 4 defrost events, and a drain delay time and pump out delay time of 1 minute each, with the maximum number of concurrent defrost events to be observed, as illustrated in FIG. 3. The default values in display 330 may be adjusted as desired by the user. As an example, the user may adjust the number of defrost events per day to 8.

Figure 4:
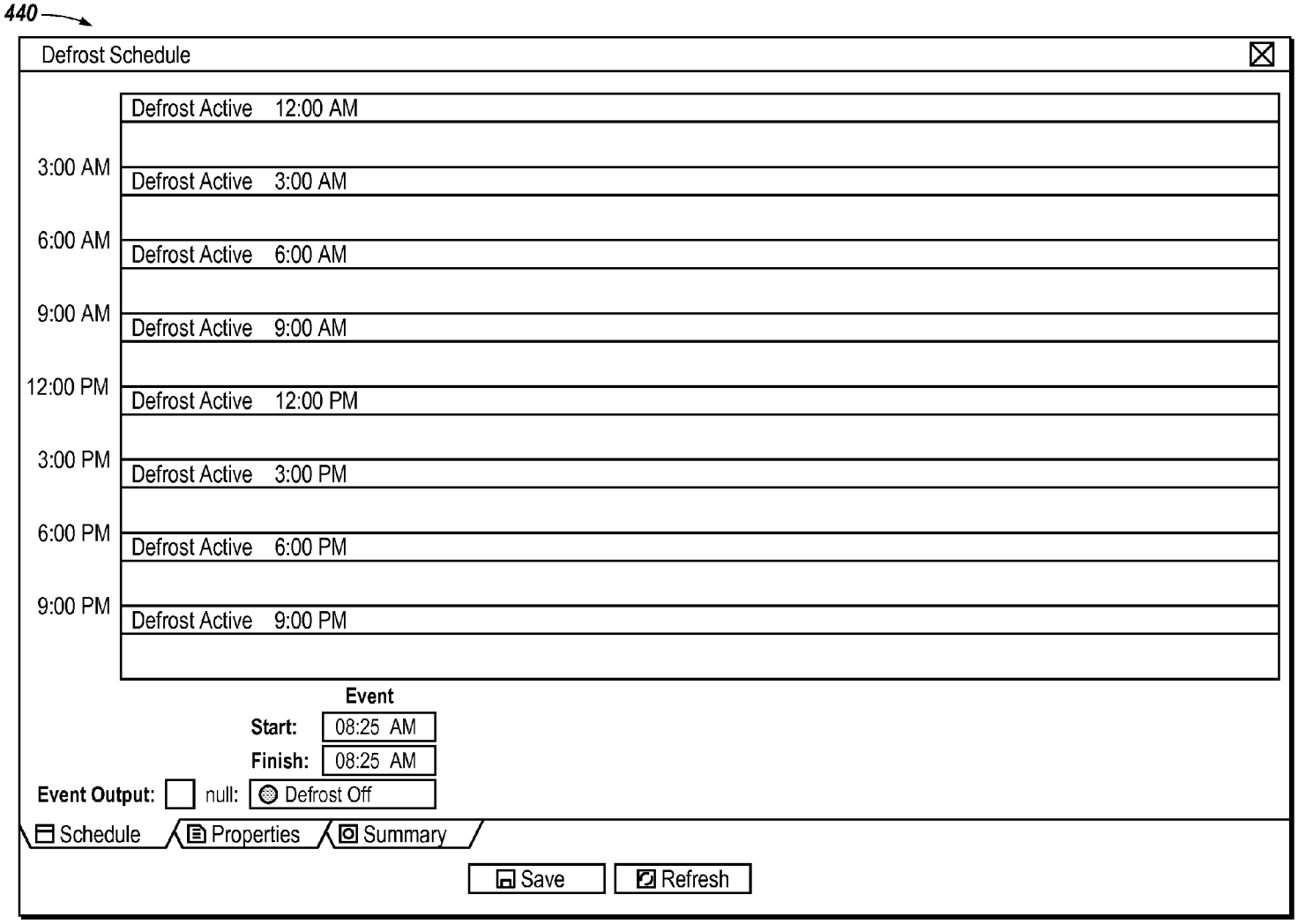

After the values for the defrost control settings for the selected circuit are set, the defrost event schedule can then be determined based on the set values. The determined schedule can then be displayed to the user, as illustrated in FIG. 4 (e.g., display 440). The schedule illustrated in display 440 was determined using the default values previously described in connection with FIG. 3, except the number of defrost events per day was adjusted from 4 to 8.

In the example illustrated in FIG. 4, the defrost event schedule displays each defrost event as a bar, with the start time of each defrost event listed within its respective bar and the height of each bar indicating the duration of its respective defrost event. In the example illustrated in FIG. 4, the schedule has placed an equal amount of time between each defrost event.

After the determined defrost event schedule is displayed to the user, the user may adjust the schedule by adjusting one or more of the defrost control settings illustrated in display 330 of FIG. 3, and the schedule displayed in FIG. 4 may be updated based on the adjustment(s) (e.g., the updated schedule may be displayed to the user). For example, if the start time of the initial defrost event in display 330 is adjusted from 12:00 AM to 2:00 AM, the defrost events in the schedule illustrated in display 440 would each shift downward in the schedule by two hours (e.g., the updated schedule would show the initial defrost event beginning at 2:00 AM, the second defrost event beginning at 5:00 AM, etc.).

As an additional example, the user may change the determined defrost event schedule to (e.g., override the determined schedule with) a fixed defrost event schedule by adjusting the "Defrost Sched Type" field illustrated in display 330 of FIG. 3 from "Defrosts Per Day" to "Fixed Schedule". This adjustment can be made, for example, by selecting the "Fixed Schedule" option from a drop down menu in the "Defrost Sched Type" field. The user may then manually enter the defrost event schedule (e.g., each individual defrost event in the schedule), and the schedule illustrated in display 440 would be updated to the fixed schedule. Further, once the defrost event schedule is adjusted to the fixed schedule, the "LT Max Def Time" "LT Defrosts/Day", and "Start Time" fields illustrated in display 330 of FIG. 3 will not be available.

In some instances, the user's adjustment to the determined defrost event schedule displayed in FIG. 4 may shift one or more of the scheduled defrost events beyond the end of the schedule (e.g., beyond the end of the day). An example of such an instance is illustrated in FIG. 5 (e.g., display 550).

Figure 5:
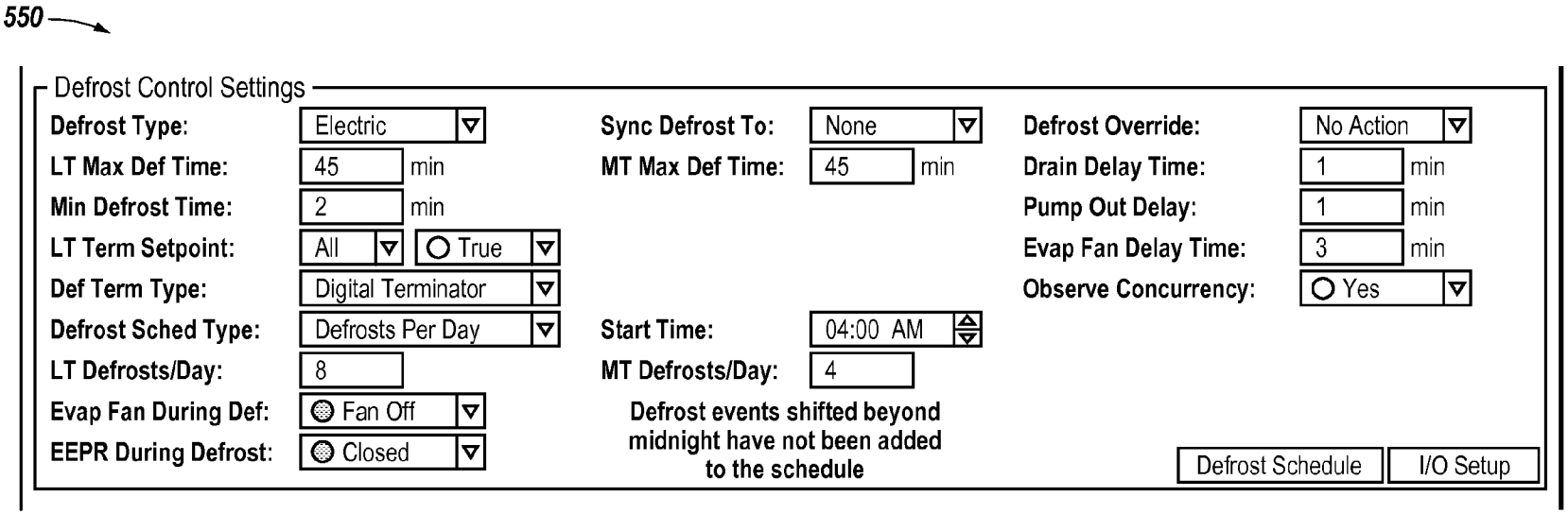

In the example illustrated in FIG. 5 (e.g., display 550), the user has adjusted the number of defrost events per day to 8, and the user has adjusted the start time of the initial defrost event in display from 12:00 AM to 4:00 AM. However, such an adjustment would shift one or more of the scheduled defrost events illustrated in display 440 beyond the end of the schedule (e.g., beyond midnight). As such, display 550 includes a message indicating that these defrost events have not been added to the updated defrost event schedule.

Further, the user can select refrigeration circuits of the group in display 220 to be linked in a master/slave relationship in accordance with the present disclosure. In the example illustrated in FIG. 6 (e.g., display 660), Circuit06 (e.g., the circuit with the name of Ckt6) has been selected to be the master circuit.

As shown in FIG. 6, display 660 includes the defrost control settings for the selected circuit (e.g., Circuit06). As shown in FIG. 6, the defrost control settings include a "Sync Defrost To" field. The user can use this field to set the selected circuit as the master circuit or a slave circuit. In the example illustrated in FIG. 6, the user has set the selected circuit (e.g., Circuit06) as the master circuit by setting the "Sync Defrost To" field in display 660 to "None".

The user can then select a refrigeration circuit(s) of the group in display 220 to be a slave(s) of the selected master circuit. In the example illustrated in FIG. 7 (e.g., display 770), Circuit07 (e.g., the circuit with the name of Ckt7) has been selected to be a slave circuit of master circuit Circuit06.

Figure 7:
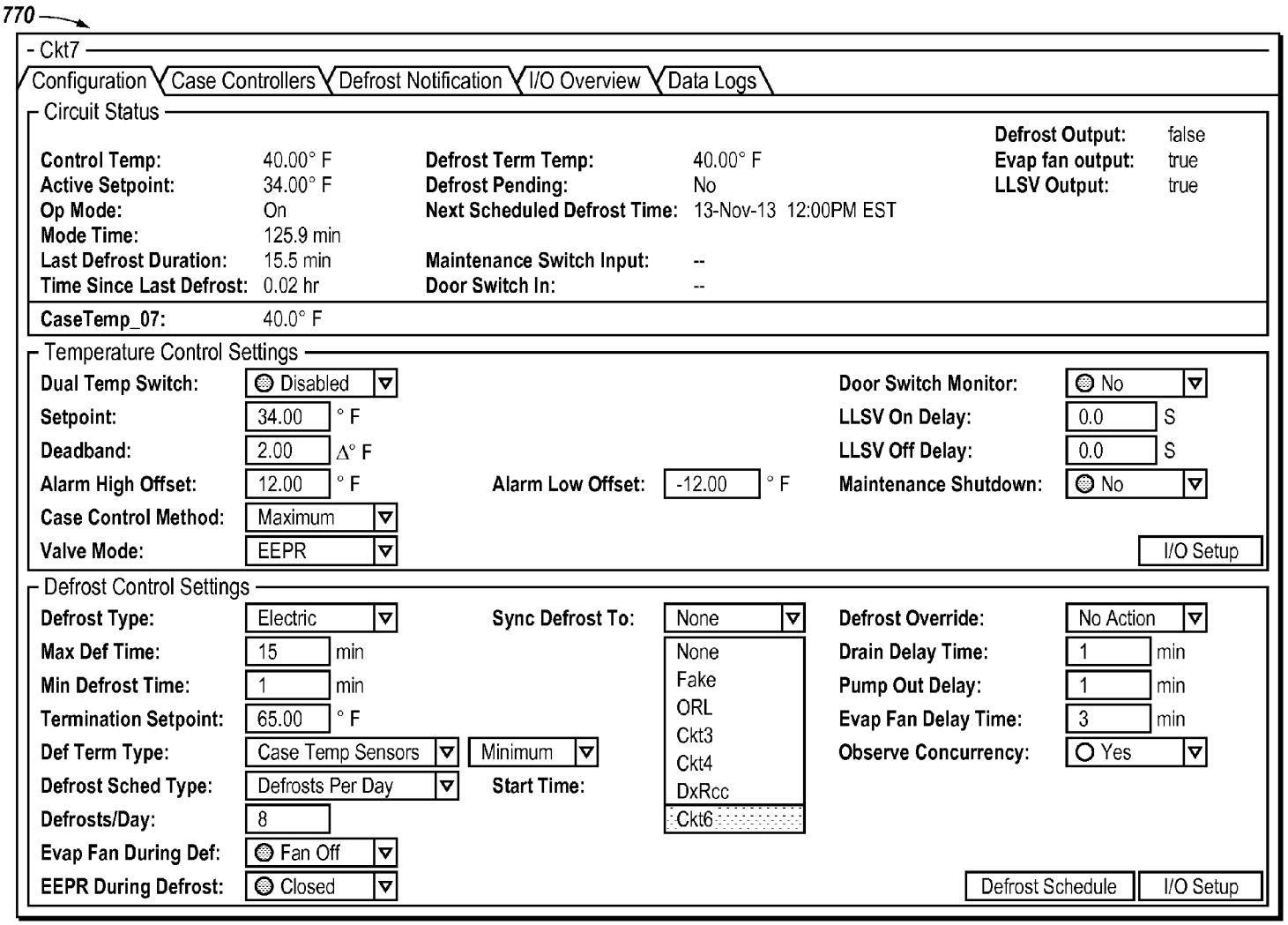

As shown in FIG. 7, display 770 includes the defrost control settings for Circuit07, including the "Sync Defrost To" field for Circuit07. The user can use this field to set Circuit07 as a slave circuit of master circuit Circuit06. In the example illustrated in FIG. 7, the user has set Circuit07 as a slave circuit of Circuit06 by selecting the name of Circuit06 (e.g., "Ckt6") from the drop down menu in the "Sync Defrost To" field. Once Circuit07 is set as a slave circuit, the other defrost control settings for Circuit07 (e.g., the "Max Defrost Time", "Defrost Sched Type", "Defrosts Per Day", "Start Time", "Drain Delay Time", Pump Out Delay", and "Observe Concurrency" fields) in display 770 will become grayed out and non-editable, as Circuit07 would become tied to the defrost control settings for master circuit Circuit06.

FIG. 8 (e.g., display 880) illustrates the updated configuration overview for the group of refrigeration circuits that reflects the master/slave relationship between Circuit06 and Circuit07. As shown in FIG. 8, the "Sync Defrost To" field for Circuit07 in display 880 is set to the name of its master circuit (e.g., "Ckt6"), while the "Sync Defrost To" field for Circuit06 in display 880 is set to "None". Further, the property sheet of Circuit07 can include the name of its master circuit (e.g., "Ckt6), and Circuit06 can identify its slave circuits by searching for its name in the other circuits of the group, as previously described herein (e.g., in connection with FIG. 1).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method of scheduling defrost events for a refrigeration system, comprising:

receiving, by a computing device, a number of defrost events per day for a refrigeration circuit, a duration for each of the number of defrost events, a single start time value that is a start time for an initial one of the number of defrost events, and a maximum number of concurrent defrost events for the refrigeration system, wherein the maximum number of concurrent defrost events for the refrigeration system is at least two, and wherein a defrost event for the refrigeration system corresponds to a time between starting and stopping a defrost of the refrigeration system;

determining, by the computing device, a defrost event schedule for the refrigeration circuit based on the number of defrost events per day, the duration for each of the number of defrost events, the single start time value that is the start time for the initial one of the number of defrost events, and the maximum number of concurrent defrost events;

receiving, by the computing device, an adjustment to the determined defrost event schedule;

updating, by the computing device, the defrost event schedule based on the adjustment; and executing, by an additional computing device, defrost events in the refrigeration system in accordance with the updated defrost event schedule.

2. The method of claim 1, wherein the method includes receiving, by the computing device, a selection of the refrigeration circuit for which the defrost event schedule is to be determined.

3. The method of claim 1, wherein the adjustment to the determined defrost event schedule includes an adjustment to the single start time value that is the start time for the initial one of the number of defrost events.

4. The method of claim 1, wherein the adjustment to the determined defrost event schedule includes changing the defrost event schedule to a fixed defrost event schedule.

5. The method of claim 1, wherein the method includes displaying, by the computing device upon an adjustment to the determined defrost event schedule shifting one or more of the number of defrost events beyond an end of the defrost event schedule, a message indicating that the one or more of the number of defrost events will not be included in the updated defrost event schedule.

6. The method of claim 1, wherein receiving the number of defrost events per day, the duration for each of the number of defrost events, the single start time value that is the start time for the initial one of the number of defrost events, and the maximum number of concurrent defrost events includes receiving an adjustment to a default value.

7. The method of claim 1, wherein the determined defrost event schedule includes a same time interval between each of the number of defrost events.

* * * * *